US005263222A

United States Patent [19]

Johnstone, II

[11] Patent Number: 5,263,222

[45] Date of Patent: Nov. 23, 1993

[54] AUTOMOTIVE WINDSHIELD ICE SCRAPER

[76] Inventor: James R. Johnstone, II, 618 E. Washington St., Hoopeston, Ill. 60942

[21] Appl. No.: 891,829

[22] Filed: Jun. 1, 1992

[51] Int. Cl.[5] ..... A47L 13/022

[52] U.S. Cl. ..... 15/236.02; 15/236.05; 15/236.06; 30/172

[58] Field of Search ..... 15/143.1, 235.4, 235.5, 15/235.6, 236.06, 236.02, 236.05, 93.1; 299/37; 30/172

[56] References Cited

U.S. PATENT DOCUMENTS

| | | | |
|---|---|---|---|
| 656,468 | 8/1900 | Mullin | 30/172 |
| 1,008,382 | 11/1911 | Sourek | 15/236.06 |
| 1,728,036 | 9/1929 | Bozowich | 30/172 |
| 2,275,713 | 3/1942 | Ahlborg | 30/172 |
| 2,395,537 | 2/1946 | Crosby | 15/236.06 |
| 2,983,943 | 5/1961 | Fendler | 15/236.06 |
| 3,363,316 | 1/1968 | Skarsten | 15/236.05 |
| 3,566,430 | 3/1971 | Young | 15/236 |
| 3,811,160 | 5/1974 | MacDonald | 15/93.1 |
| 4,040,140 | 8/1977 | Hopkins et al. | 15/236 |
| 4,141,111 | 2/1979 | Hopkins et al. | 15/136 |
| 4,164,801 | 8/1979 | Thomas | 15/236 |
| 4,275,476 | 6/1981 | Hopkins et al. | 15/236 |
| 4,305,175 | 12/1981 | Burgess,Jr. | 15/236 |
| 4,364,145 | 12/1882 | Jones et al. | 15/236 |
| 4,422,206 | 12/1983 | Brace et al. | 15/236 |
| 4,543,680 | 10/1985 | Vlahos | 15/145 |
| 4,574,417 | 3/1986 | Magnasco | 15/236.05 |
| 4,719,660 | 1/1988 | Hopkins | 15/105 |
| 4,979,302 | 12/1990 | Magnasco | 30/172 |

FOREIGN PATENT DOCUMENTS

| | | | |
|---|---|---|---|
| 287684 | 10/1915 | Fed. Rep. of Germany | 30/172 |
| 193739 | 1/1965 | Switzerland | 15/236.05 |

*Primary Examiner*—Harvey C. Hornsby
*Assistant Examiner*—Randell E. Chin
*Attorney, Agent, or Firm*—Roberts and Quiogue

[57] ABSTRACT

A double-bladed ice and snow scraper positions the handle so that considerable scraping force can be comfortably applied. The two blades are separated and present a stable platform so that more scraping force can be applied safely and comfortably.

15 Claims, 1 Drawing Sheet

AUTOMOTIVE WINDSHIELD ICE SCRAPER

BACKGROUND OF THE INVENTION

The present invention relates to the field of ice scraping apparatus for removing ice and snow from vehicle windshields and the like.

There are various ice scraper designs presently in existence. These designs include the ice scrapers disclosed in the following U.S. Pat. Nos.: 4,275,476; 4,719,660; 4,422,206; 4,305,175; 4,364,145; 4,164,801; 4,040,140; 4,141,111; 3,566,430; 2,275,713.

It is an object of the present invention to provide an improved ice and snow scraper which includes a handle positioned for comfort even when considerable force is being applied to the device.

A further object is to provide an improved ice and snow scraper device which includes two blades to produce a more efficient scraping action than a single blade, and to provide a more stable platform so that more force can be exerted on the scraper tool without jeopardizing the safety and comfort of the user.

SUMMARY OF THE INVENTION

An improved ice and snow scraper tool for automotive windshields and the like in accordance with this invention comprises front and rear scraper blades, separated by a platform member attached to the front and rear blades. A handle member is fitted between the front and rear blades and positioned above the platform member so as to permit the user's fingers to fit between the handle and the platform member when the scraper tool is in use. The handle is canted from front to back so as to position the handle member for comfortable gripping while the scraper tool is forcibly urged across the surface of a windshield or the like in a scraping motion.

In the preferred embodiment, the handle member is canted at an angle of approximately 20 degrees from the horizontal, and the handle member comprises a generally U-shaped member including a transverse element which connects relatively short, front and rear leg members, the front leg member attached to the front scraper and to the front end of the platform member, and the rear leg member attached to the rear scraper blade and to the rear end of the platform member.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Figure 1:
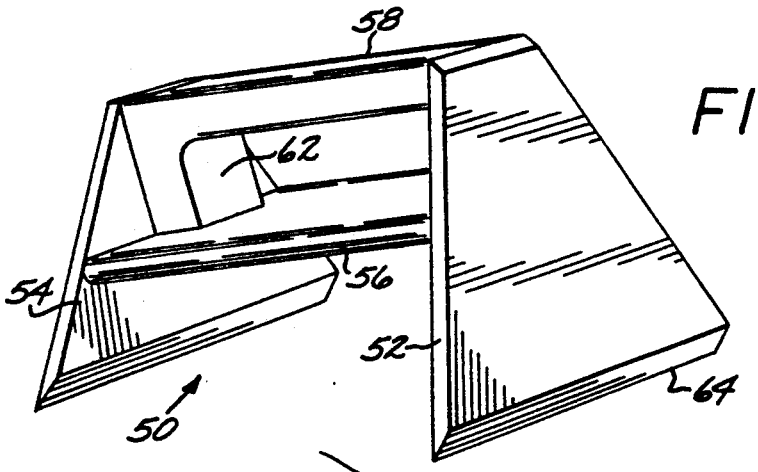
FIG. 1 is a perspective view of a dual bladed ice and snow scraper tool embodying the present invention.
Figure 2:
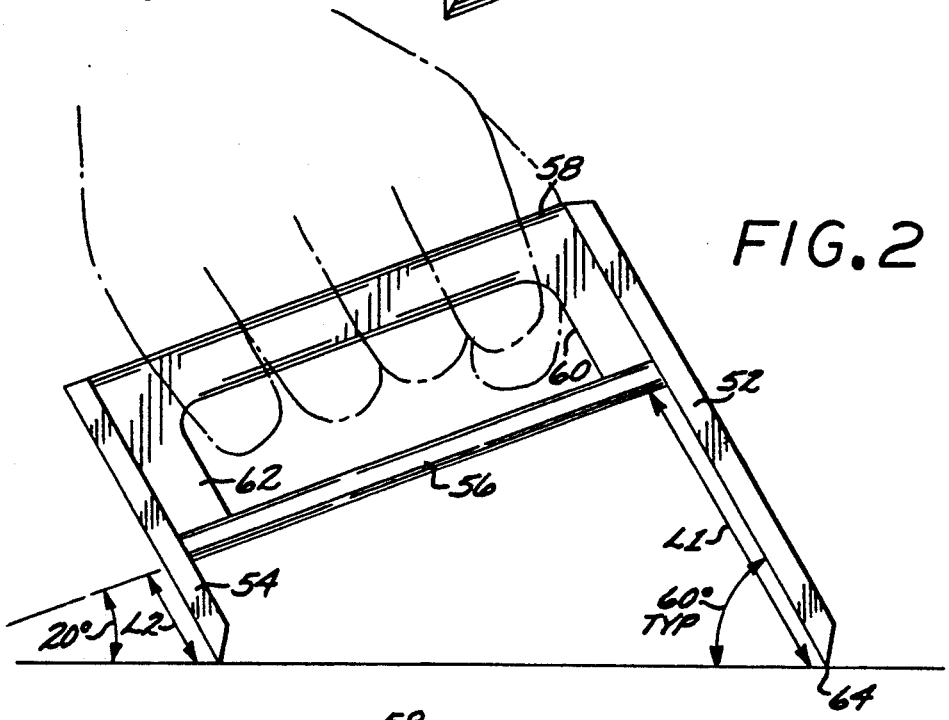
FIG. 2 is a side view of the scraper tool of FIG. 1.
Figure 3:
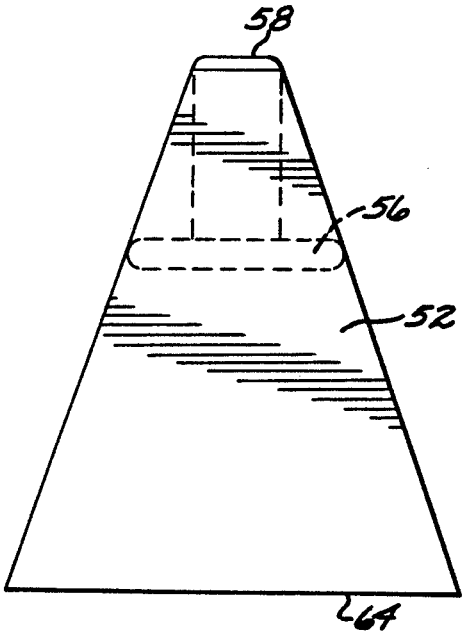
FIG. 3 is a front view of the scraper tool of FIG. 1.

A preferred embodiment of an ice and snow scraper tool 50 in accordance with the invention is shown in FIGS. 1-3. The tool 50 comprises front and back scraper elements 52 and 54, secured together by a platform member 56 and a handle member 58. These elements may all be fabricated of hard plastic material such as acrylic, polycarbonate or similar polymer material. The handle member 58 comprises an inverted U-shaped member having a width of about 4.5 inches, with the relatively short legs 60 and 62 providing substantial surfaces to which the scraper elements 52 and 54 may be secured, e.g., by adhesives or fastener elements (not shown). The preferred embodiment, however, is a one piece molded construction, wherein the elements 52, 54, 56, 58, 60 and 62 are all molded together to form a single unitary member. The ends of the handle legs 60 and 62 rest against the platform 56, which in this embodiment has a substantial lateral or width dimension approximately the same as the width of the adjacent portions of the scraper tool members.

As best shown in FIG. 2, the front scraper element 52 is considerably longer or taller than the rear scraper element 54. In this exemplary embodiment, the front scraper element has a length dimension L1 which is 2.5 inches, while the rear scraper element has a corresponding dimension L2 which is 1.0 inches. As a result, the platform and handle are canted at an angle of about 20° when the tool 50 is resting on a flat surface, which provides a much more comfortable, ergonomically correct gripping position for the user than if the front and rear scraper elements were of equal length.

With the tool 50 resting on a flat surface, the front blade 52 and the rear blade 54 in this embodiment are positioned at an approximate angle of 60° from the flat surface.

The tool 50 permits the user to grip the handle 58 with one hand and bear down on the tool with considerable force comfortably. The handle 58 is separated from the platform 56 by a sufficient distance to permit the user's fingers to be easily fitted therebetween. The platform 56 provides additional stiffness to the scraper tool 50, and helps keep ice and snow off the hands of the user. The handle 58 is wide enough to provide a comfortable grasping element. And with the angle at which the handle is canted, the tool provides an ergonomic grasping tool, permitting ice or snow removal from a vehicle window with relative ease in comparison to single blade scraper tool design.

It is understood that the above-described embodiments are merely illustrative of the possible specific embodiments which may represent principles of the present invention. For example, the platform member 56 could be omitted, provided the handle is designed to properly stabilize and support the front and rear scraper blades. The tool would then have a generally U-shaped side-view configuration. Other arrangements may readily be devised in accordance with these principles by those skilled in the art without departing from the scope and spirit of the invention.

What is claimed is:

1. A lightweight, hand-powered ice and snow scraper tool for vehicle windshields comprising:

front and rear scraper blades suitable for scraping ice or snow from said windshield;

means for supporting said front and rear scraper blades in a separated configuration; and a handle member secured between said front and rear blades and comprising a generally U-shaped member comprising a transverse element which connects front and rear leg members, said front leg member attached to said front scraper, and said rear leg member attached to said rear scraper, said handle member being canted from front to back when said blades are resting on said windshield so as to position said handle member for comfortable gripping while the scraper tool is forcibly urged by the hand motion of the user across the surface of said windshield or the like in a scraping motion to remove ice or snow from said windshield.

2. The scraper tool of claim 1 wherein said handle member is canted at an angle of approximately 20 degrees from the horizontal when said blades are resting on said windshield, the handle member end adjacent said front scraper blade being higher than the handle member end adjacent said rear scraper blade.

3. The scraper tool of claim 1 wherein said rear blade member is shorter than said front blade member to thereby effect said canting of said handle member.

4. The scraper tool of claim 1 wherein said front and rear scraper blades, said supporting means and said handle member are all fabricated of a hard plastic material.

5. The scraper tool of claim 4 wherein said tool is a one-piece unitary member, and said front and rear scraper blades, said supporting means and said handle member are molded together to form said one-piece unitary member.

6. A hand-powered ice and snow scraper tool for vehicle windshields comprising:

front and rear scraper blades suitable for scraping ice or snow from said windshield;

a platform member attached to said front and rear blades, said platform member serving to separate said blades;

a handle member fitted between said front and rear blades and positioned above said platform member so as to permit the user's fingers to fit between said handle and said platform member when said scraper tool is in use, said handle member comprising a generally U-shaped member comprising a transverse element which connects front and rear leg members, said front leg member attached to said front scraper and to the front end of said platform member, and said rear leg member attached to said rear scraper and to the rear end of said platform member, said handle member being canted from front to back when said blades are resting on said windshield so as to position said handle member for comfortable gripping while the scraper tool is forcibly urged by the hand motion of the user across the surface of said windshield or the like in a scraping motion to remove ice or snow from the windshield.

7. The scraper tool of claim 6 wherein said handle member is canted at an angle of approximately 20 degrees from the horizontal when said blades are resting on said windshield, the handle member end adjacent said front scraper blade being higher than the handle member end adjacent said rear scraper blade.

8. The scraper tool of claim 6 wherein said platform member comprises a generally planar rectangular member.

9. The scraper tool of claim 6 wherein said rear blade member is shorter than said front blade member to thereby effect said canting of said handle member.

10. The scraper tool of claim 6 wherein said front and rear scraper blades, said platform member and said handle member are all fabricated of a hard plastic material.

11. The scraper tool of claim 10 wherein said tool is a one-piece unitary member, and said front and rear scraper blades, said platform member and said handle member are molded together to form said one-piece unitary member.

12. A hand-held, hand-powered, one-piece ice scraper tool for cleaning ice from vehicle windshields, said tool defining:

front and rear scraper blades supported in a separated configuration and suitable for scraping ice from said windshield; and a handle secured between said separated front and rear blades, and comprising a generally U-shaped member comprising a transverse element which connects front and rear leg members, said front leg member attached to said front scraper, and said rear leg member attached to said rear scraper, said handle being canted from front to back when said blades are resting on said windshield so as to position said handle member for comfortable gripping while the scraper tool is being forcibly urged by the hand motion of the user across the surface of the windshield or the like in a scraping motion to remove ice from said windshield.

13. The scraper tool of claim 12 wherein said tool is fabricated of a molded plastic material.

14. The scraper tool of claim 12 wherein said rear blade is shorter than said front blade member to thereby effect said canting of said handle.

15. The scraper tool of claim 12 wherein said handle is canted at an angle of about 20 degrees from the horizontal when said blades are resting on a horizontal surface.

* * * * *